United States Patent [19]

Komatsu et al.

[11] Patent Number: 4,992,240

[45] Date of Patent: Feb. 12, 1991

[54] ALLOYS BASED ON ZIRCONIUM HAVING PROPORTIONAL AMOUNT OF TIN, IRON, CHROMIUM AND OXYGEN

[75] Inventors: Kazushi Komatsu; Toshiya Kido; Toshimichi Takahashi; Mitsuru Sugano; Shigemitsu Suzuki, all of Tokyo, Japan

[73] Assignee: Mitsubishi Jukogyo Kabushiki Kaisha, Tokyo, Japan

[21] Appl. No.: 359,339

[22] Filed: May 31, 1989

[30] Foreign Application Priority Data

Jun. 6, 1988 [JP] Japan ..... 63-137433

[51] Int. Cl.[5] ..... C21D 1/26

[52] U.S. Cl. ..... 420/422; 148/11.5 F; 148/133

[58] Field of Search ..... 420/422; 148/11.5 F, 148/133

[56] References Cited

U.S. PATENT DOCUMENTS 3,963,534 6/1976 Frenkel et al. ..... 148/11.5 F
4,649,023 3/1987 Sabol et al. ..... 420/422
4,689,091 9/1987 Yoshida et al. ..... 148/11.5 F
4,775,428 10/1988 Bonel et al. ..... 420/422
4,775,508 10/1988 Sabol et al. ..... 420/422
4,879,093 11/1989 Garde ..... 420/422

FOREIGN PATENT DOCUMENTS 0036640 2/1985 Japan ..... 420/422

*Primary Examiner*—Upendra Roy
*Attorney, Agent, or Firm*—Fleit, Jacobson, Cohn, Price, Holman & Stern

[57] ABSTRACT

A zirconium alloy containing on weight basis, 0.4–1.2% tin, 0.2–0.4% iron, 0.1–0.6% chromium, not higher than 0.5% of niobium and balance oxygen and zirconium, wherein the sum of weight proportions of tin, iron and chromium is in the range from 0.9 to 1.5%; and a zirconium alloy as above wherein the proportions, expressed by weight %, of tin $X_{Sn}$, iron $X_{Fe}$, chromium $X_{Cr}$, niobium $X_{Nb}$ and oxygen $X_o$ satisfy the equation $$X_{Sn}^{0.18}+0.15(X_{Fe}+X_{Cr})+0.13X_{Nb}+4.72X_o \geqq 0.95.$$

4 Claims, 5 Drawing Sheets

ALLOYS BASED ON ZIRCONIUM HAVING PROPORTIONAL AMOUNT OF TIN, IRON, CHROMIUM AND OXYGEN

BACKGROUND OF THE INVENTION

The present invention relates to alloys based on zirconium to be employed for example as construction members in the nuclear reactor of a nuclear power plant etc. and to a method for treating these alloys.

A typical fuel assemply employed in a nuclear power plant has a construction as generally shown in the elevational view of appended FIG. 2 in which a plurality of fuel elements 7, constructed as shown in FIG. 1, in a vertical section are assembled in a form of upright lattice. Nuclear fuels 1 each consisting of a cylindrical sintered product of uranium oxide (denoted hereinafter as pellet) are packed in a sheath tube 2 sealed at both ends with terminal stoppers 4, 5. A coil spring 3 tightens the pellets 1 within the sheath tube 2. A number of the so constructed fuel elements 7 are supported on support gratings 6 and arranged to build up a fuel assembly having an upper nozzle 8, a bottom nozzle 9, a suspending diaphragm spring 10 and a control rod cluster 11.

As the materials for the sheath tube 2 of the fuel element 7 and for the support grating 6, zirconium alloys R60802 or R60804 of UNS (Unified Numbering System for Metals and Alloys) defined by ASTM B353 (designated hereinafter as Zircaloy 2 and Zircaloy 4 for the former and for the latter respectively) have conventionally been employed, wherein the former is a zirconium alloy containing tin, iron, chromium and nickel each in a small amount.

During running of a nuclear power plant, the outer surfaces of internal construction members in the nuclear reactor are held in contact with the cooling water maintained at high temperature under high pressure so that the materials consisting of zirconium alloys constitutung these members will be subjected to corrosion, namely, a high temperature reaction with hot water or with high temperature steam to form a uniform or lacal oxide cover layer while the hydrogen formed thereby penetrates through the oxide layer and is absorbed in the alloy. Upon progression of such reaction (hereinafter denoted as corrosion) with corresponding thickening of the oxide cover layer and decrease in the virtual thickness of the body of alloy, the mechanical strength of construction members, such as sheath tube 2, support grating 6 and so on, made of zirconium alloy, decreases. In addition, the strength and ductility of zirconium alloy construction members decrease with the increase in the amount of hydrogen absorbed in the alloy, which is formed by the above-mentioned corrosion reaction. Thus, the corrosion of sheath tubes 2 and support gratings 6 may result in a reduction of the performances of these members due to the decrease in the strength and the ductility. In the practice however, the extent of corrosion on the outer surfaces of sheath tubes and support gratings is quite small under the running condition of nuclear power plant of nowadays and, thus, has not reached hitherto any failure in the proper functions of these members.

However, there has been, in fact, a problem, as mentioned above, of possible occurrence of failure in the performances of the members made of zirconium alloys, especially in the case where the fission rate of the nuclear fuel is increased and the retention time of the fuel within the nuclear reactor is extended so as to attain an efficient utilization of the nuclear fuel, due to the progression of the above-mentioned corrosion on the outer surfaces of construction members, such as sheath tubes and support gratings made of zirconium alloys, resulting in a thickening of the zirconium oxide outer layer with corresponding decrease in the virtual thickness of the zirconium alloy body, together with the existing danger of destruction of proper functions of the zirconium alloy construction members by the increase in the amount of hydrogen absorbed in the alloy.

In order to improve the corrosion resistance of zirconium alloys. a countermeasure had been proposed, as disclosed in the Japanese patent application Ser. No. Sho 62-46709, in which the amounts of subsidiary alloy elements tin, iron, chromium and niobium are adjusted adequately. It was reported, in particular, that a marked increase in the corrosion resistance was recognized by reducing the content of tin.

By such an adjustment of the contents of subsidiary alloy elements, however, change in the mechanical properties, such as strength etc., of the alloy material will result also. In particular, by reducing the content of tin, a decrease in the creep strength as compared with that of conventional materials of the sheath tube of fuel element and the support grating will result, so that there occurs a danger of greater decrement in the outer diameter of the fuel element to occur during the operation of the nuclear reactor when using such a material for the sheath tube, whereby a possibility occurs that the sheath tube or the like will be loaded by too high a stress upon an abrupt increase in the output power.

BRIEF SUMMARY OF THE INVENTION

An object of the present invention is to obviate the problems memtioned above.

Another object of the present invention is to provide novel zirconium alloys exhibiting a superior corrosion resistance together with a high mechanical strength, permitting use in nuclear reactors with a considerably long term residence therein and satisfying the requirements in operation of the reactor with frequent variations in the atomic power output.

A further object of the present invention is to propose methods for treating such alloys for improving the properties thereof.

The above objects of the present invention are achieved by zirconiun alloys of the present invention and by the methods for treating such alloys as described below.

The zirconium alloy of the invention contains the three elements tin, iron and chromium with or without niobium and comprises, on weight % basis, 0.4–1.2% of tin, 0.2–0.4% of iron, 0.1–0.6% of chromium, not higher than 0.5% of niobium and the balance zirconium, wherein the sum of weight proportions of tin, iron and chromium is in the range from 0.9 to 1.5% and wherein the proportions, expressed by weight %, of tin $X_{Sn}$, iron $X_{Fe}$, chromium $X_{Cr}$, niobium $X_{Nb}$ and oxygen $X_o$ satisfy the following equation:

$$0.18X_{Sn}+0.15(X_{Fe}+X_{Cr})+0.13X_{Nb}+4.72X_o \geqq 0.95.$$

The zirconium alloy of another embodiment of the invention contains the three elements tin, iron and chromium with or without niobium and comprises, on weight % basis, 0.4–1.2% of tin, 0.2–0.4% of iron, 0.1–0.6% of chromium, not higher than 0.5% of niobium and the balance zirconium, wherein the sum of weight proportions of tin, iron and chromium is in the range from 0.9 to 1.5%.

The method for treating these zirconium alloys comprises effecting the final annealing of the alloy material either at a temperature of 430°–480° C for 2–4 hours for the former or at a temperature of 480°–540° C for 2–4 hours for the latter.

The alloys according to the present invention decrease the rate of corrosion due to reaction with high temperature water or with high temperature steam when used for construction members in a nuclear reactor with simultaneous prevention of decrease in the mechanical strength, since the contents for the principal alloy elements and the temperature of final annealing of the alloy material are controlled suitably. Thus, it is made possible to extend the residence time of the members made of the alloys according to the invention considerably with preservation of proper performances of the construction members, such as sheath tubes, support gratings and so on upon an abrupt increase in the output power.

BRIEF DESCRIPTION OF THE DRAWINGS

The invention will now be described in detail with reference to the accompanying drawings, wherein.

DETAILD DESCRIPTION OF PREFERRED EMBODIMENT

The employment of zirconium alloys for construction members in a nuclear reactor of an atomic power plant has been known, as mentioned previously, by the Japanese patent application Ser. No. Sho 62-46709. The alloys based on zirconium having the alloy composition defined according to the present invention, however, have a superior capability of preventing high temperature corrosion as compared with conventional zirconium alloys such as Zircaloy 4 etc.

Below, the present invention is further described in detail by way of preferred examples applied for a construction member installed in a nuclear reactor of an atomic power plant, in particular, with respect to the mechanical strength, with reference to the appended Drawings.

Experiments were carried out for alloy samples of compositions within and out of the scope of the invention, each of which had been worked up into a construction member of a nuclear reactor of an atomic power plant. The results of these experiments are recited in the following Table 1, in which relative values of yield stress (relative yield stress) of the samples determined at a temperature of 385° C and the alloy compositions for the principal alloy elements are given.

For preparing the test specimen of, for example, alloy sample No. 1 in Table 1, an alloy based on zirconium containing 1.55% by weight of tin, 0.20% by weight of iron and 0.11% by weight of chromium was worked up by hot rolling, β-heat treatment, several repeats of cold rolling and in-process annealing, a cold working and final annealing at 470° C for 2–4 hours for removing the remaining internal stress.

Each plate specimen of these zirconium alloys was subjected to a tensile test at a temperature of 385° C in the atmosphere to determine the yield stress, the result of which is given in Table 1. Here, the value of relative yield stress given in Table 1 is the relative value of each observed yield stress relative to that of a known zirconium alloy revealing the highest yield stress, namely, Zircaloy 4 recited as sample No. 1 in Table 1.

TABLE 1

| Sample No.(2) | Composition for Principal Elements in Zr-Alloy(1) Wt. –% Composition for Sn | Fe | Cr | Nb | O | Relative Yield Stress at 385° C |
|---|---|---|---|---|---|---|
| 1 | 1.55 | 0.20 | 0.11 | — | 0.134 | 1.0 |
| 2 | 1.34 | 0.22 | 0.11 | 0.056 | 0.134 | 0.99 |
| 3 | 1.35 | 0.24 | 0.12 | 0.153 | 0.162 | 1.08 |
| 4 | 0.48 | 0.13 | — | 0.110 | 0.137 | 0.87 |
| 5 | 0.78 | 0.13 | — | 0.100 | 0.138 | 0.90 |
| 6 | 1.17 | 0.13 | — | 0.110 | 0.142 | 0.95 |
| 7 | 1.20 | 0.14 | — | 0.110 | 0.151 | 1.00 |
| 8 | 1.35 | 0.24 | 0.11 | 0.050 | 0.150 | 1.02 |
| 9* | 0.40 | 0.31 | 0.56 | — | 0.171 | 1.02 |
| 10 | 0.57 | 0.23 | 0.40 | 0.206 | 0.148 | 0.94 |

Notes:
(1)Content of impurities corresponds to ASTM B 353 R60804.
(2)Samples according to the invention are marked with *.

Figure 1:
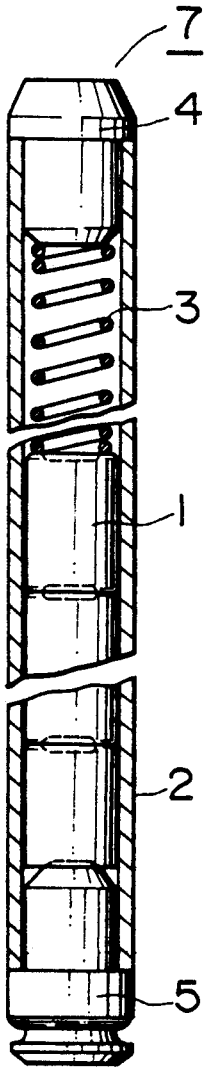
FIG. 1 illustrates, in a schematic vertical cross section, a typical fuel element employed in conventional nuclear reactors and also according to the invention.
Figure 2:
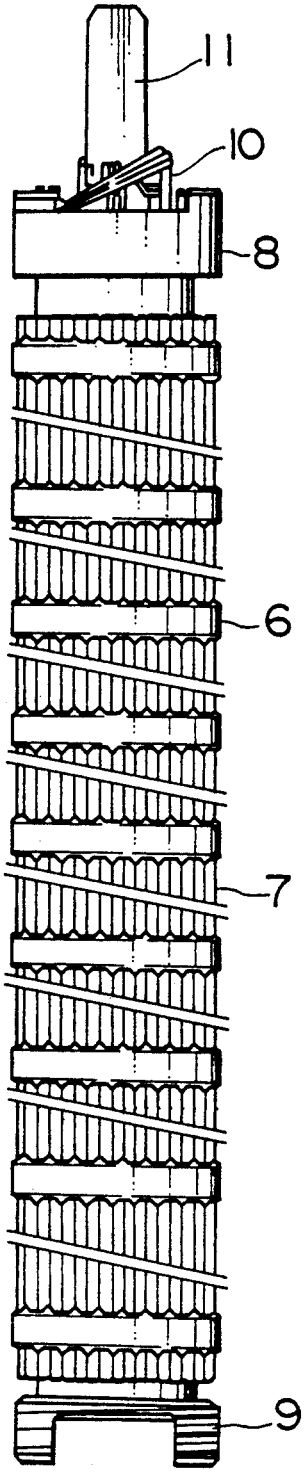
FIG. 2 is a schematic elevational view of a typical fuel assembly.
Figure 3:
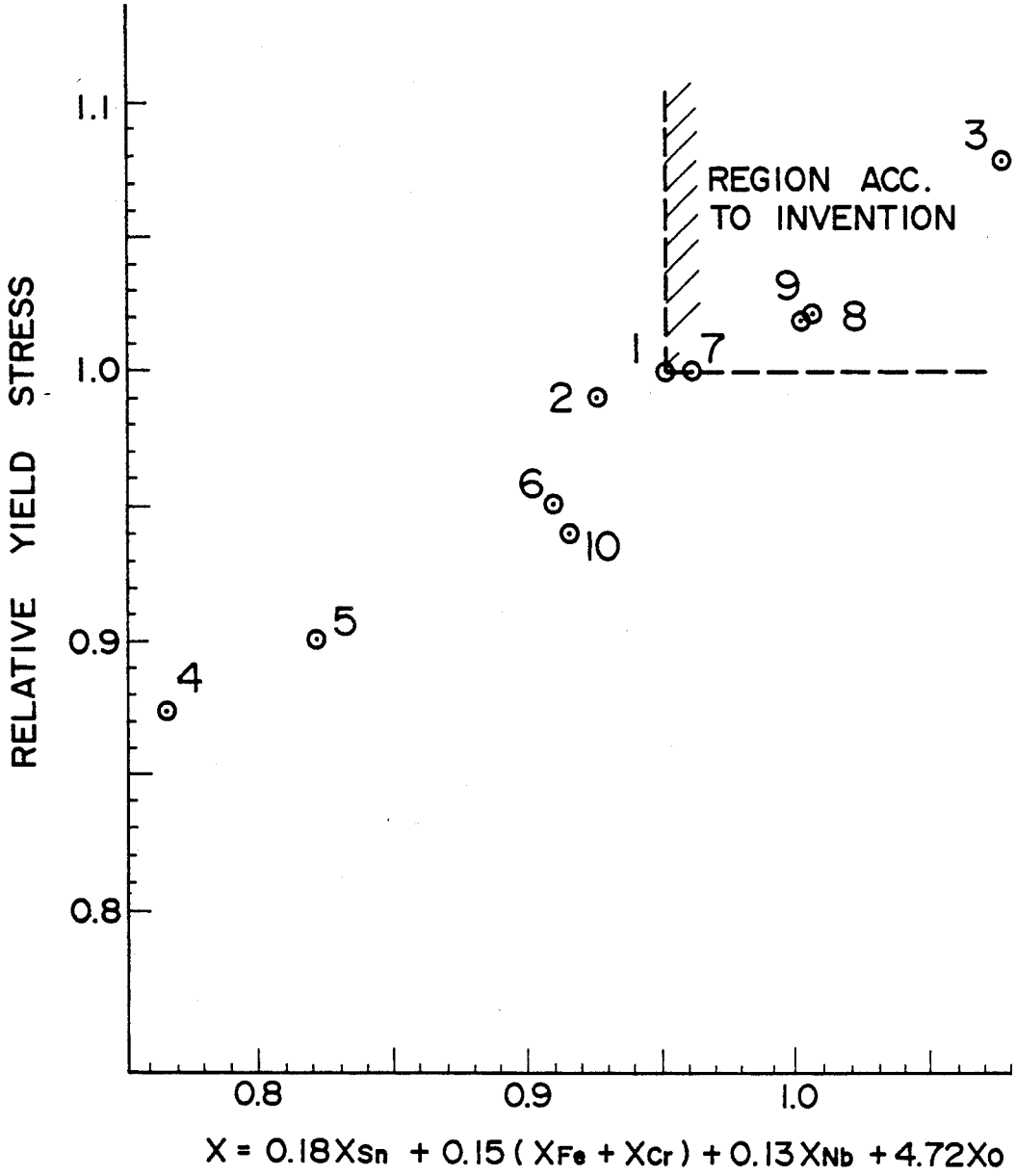
FIG. 3 is a graph showing the relationship between the relative yield stress (ordinate) and the value X (abscissa) calculated for the content of each alloy elements in the alloy material according to the invention.

FIG. 3 is a graph showing the relationship between the relative yield stress observed and the sum X as calculated by the equation:

$$X=0.18X_{Sn}+0.15(X_{Fe}+X_{Cr})+0.13X_{Nb}+4.72X_{O}$$

for the samples of Table 1, in which $X_{Sn}$, $X_{Fe}$, $X_{Cr}$, $X_{Nb}$ and $X_O$ each represent the wt.-% content of tin, iron, chromium, niobium and oxygen respectively.

As seen from FIG. 3, the relative yield stress increases linearly with the increase in the sum X calculated as above. When the value X amounts to 0.95 or higher, the yield stress of the zirconium alloy reaches at least the highest value of known zirconium alloys.

Thus, by adjusting each content of iron, chromium, niobium and oxygen suitably in accordance with the above equation for compensating the decrease in the mechanical strength due to the reduction of the content of tin in the alloys of the present invention as compared with that in the zirconium alloys of prior art, it is now made possible by the alloys according to the present invention to reduce the rate of high temperature corrosion of zirconium alloy construction members at a considerable degree without suffering from decrease in the mechanical strength of the alloy material.

Thus, for example, the zirconium alloy of sample No. 9 according to the present invention has a lower tin content of 0.4% by weight as compared with that of the alloy of sample No. 1. However, by adjusting each content of iron, chromium and oxygen in accordance with the above equation, it is possible to maintain a mechanical strength comparable to or even greater than that of the alloy of sample No. 1.

Figure 4:
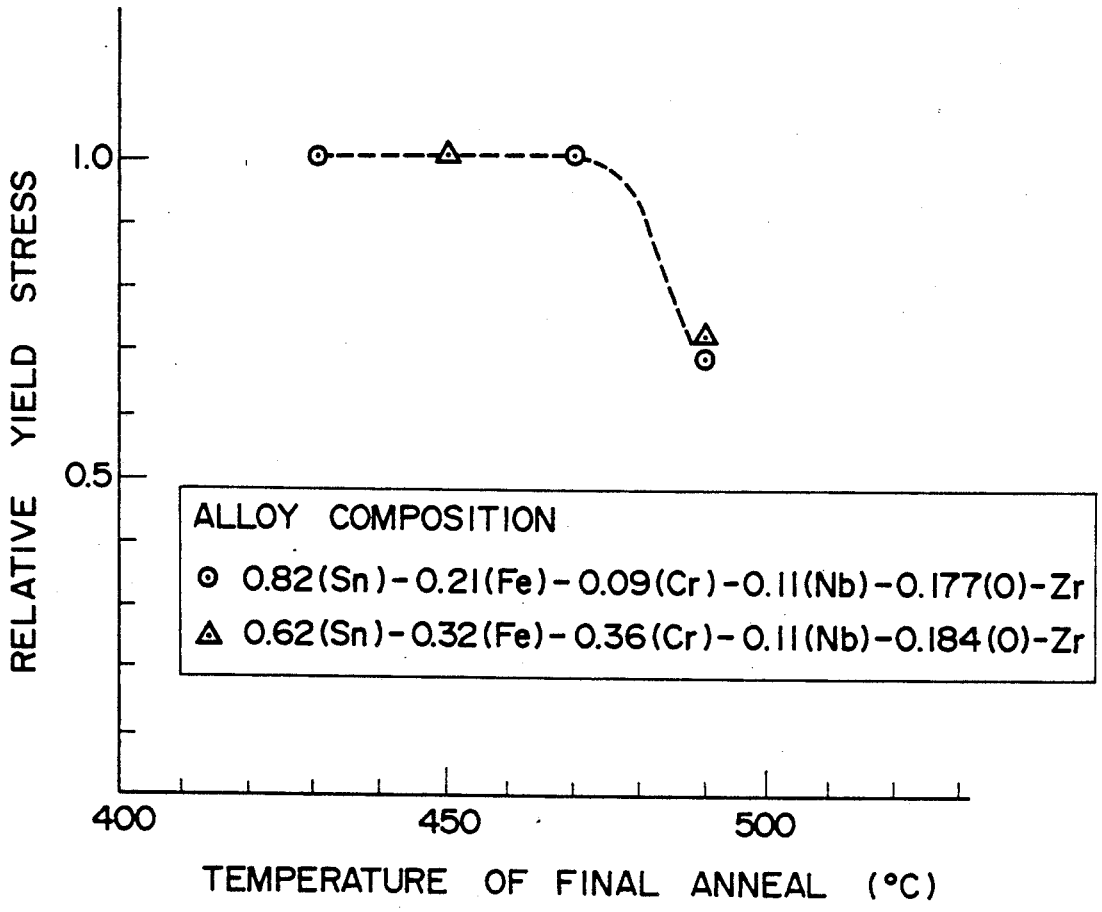
FIG. 4 is a graph showing the relationship between the relative yield stress (ordinate) and the temperature of final annealing (abscissa) for the alloy material according to the invention.

FIG. 4 is a graph showing the relationship between the relative yield stress and the temperature of final annealing for the alloy samples of the present invention given in Table 1 determined by the tensile test at 385° C in the atmosphere. Here, the relative yield stress of FIG. 4 is a relative value of each observed yield stress relative to the yield stress of one zirconium alloy material of the invention subjected to the final annealing at a temperature of 430° C.

In conventional practice, zirconium alloys are, in general, subjected to the final annealing at a temperature of at least 430° C for 2–4 hours after the final cold working of the alloy, in order to remove the remaining internal stresses in the material accumulated during the working. In this de-stressing annealing, the influence on the change in the metallurgical structure of the material is higher by the annealing temperature than by the annealing duration, so that a selection of too high an annealing temperature may result in a change of metallurgical structure from the in-working structure to the recrystallized structure, causing thereby lowering of the mechanical strength.

It had been known that a change in the metallurgical structure for the known material of Zircaloy 4 by annealing begins at an annealing temperature over 500° C. It has now been found, as seen in FIG. 4, that a change in the metallurgical structure on the final annealing begins in the materials of zirconium alloy according to the present invention at an annealing temperature above 480° C with accompaniment of decrease in the yield stress.

Thus, according to the present invention, it is now made possible to prevent the decrease of yield stress resulting from the conventional practice of final annealing, by carrying out the final annealing of the materials of zirconium alloys according to the present invention at a temperature between 430° C and 480° C for 2–4 hours.

Now, the invention will further be described by way of another example with the zirconium alloys of the invention applied for a sheath tube of fuel element for an atomic energy power plant, specifically with respect to the mechanical strength of the material.

Figure 5:
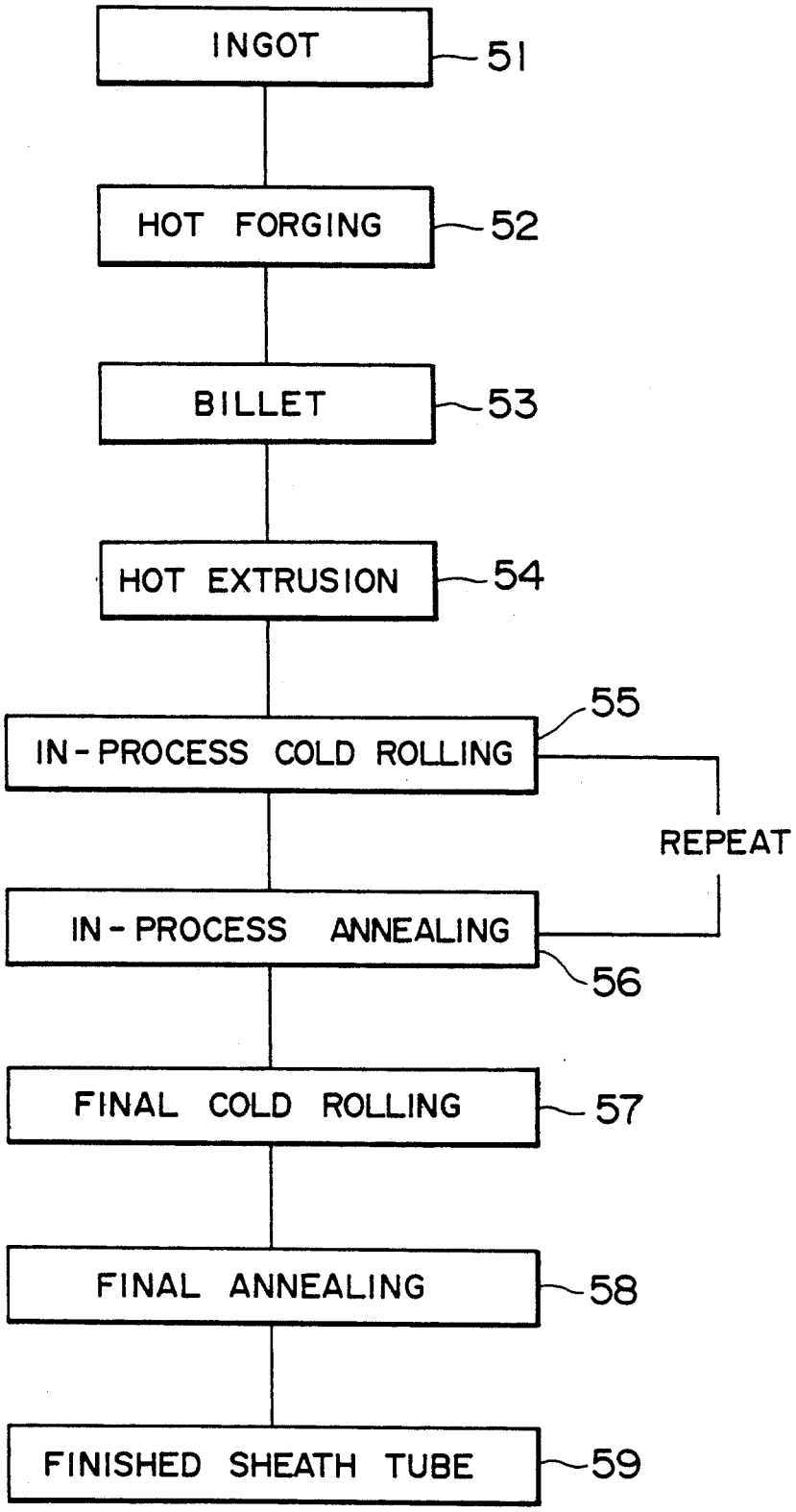
FIG. 5 show the flow chart of the process steps for making a sheath tube from the alloy according to the invention.

FIG. 5 is a flow chart explaining the manufacturing process steps of a sheath tube from the zirconium alloy of the present invention. An ingot (51) in a form of a rod having an outer diameter of about 600 mm is worked by a hot forging (52) at a temperature of 700°–1100° C to reduce the outer diameter up to about 200 mm, whereupon a billet is formed (53) by boring the rod along its central axis. Then, the billet is hotextruded (54) at about 800° C to form a tube, followed by several repeats of a series of processings of in-process cold rolling (55) at room temperature with a reduction in the sectional area of the tube of 70–80% upon each cold rolling and a following in-process annealing (56) at a temperature of 600°–700° C for about 4 hours for easing the subsequent repeat of the in-process cold rolling. After the final repeat of the cold rolling (57), the material is subjected to the final annealing (58) in order to adjust the requisite mechanical properties and in order to remove the remaining internal stresses accumulated during the working to obtain the finished sheath tube (59).

Samples of a sheath tube having an outer diameter of 9.5 mm and a wall thickness of 0.6 mm were prepared using a zirconium alloy containing 0.8% by weight of tin, 0.2% by weight of iron, 0.1% by weight of chromium and 0.1% by weight of niobium according to the invention in accordance with the prosess steps as given in FIG. 5 with varying final annealing temperatures within a range from 430° C to 550° C for about 3 hours. Using these samples, an internal compression creep test was carried out to observe the creep strength.

Figure 6:
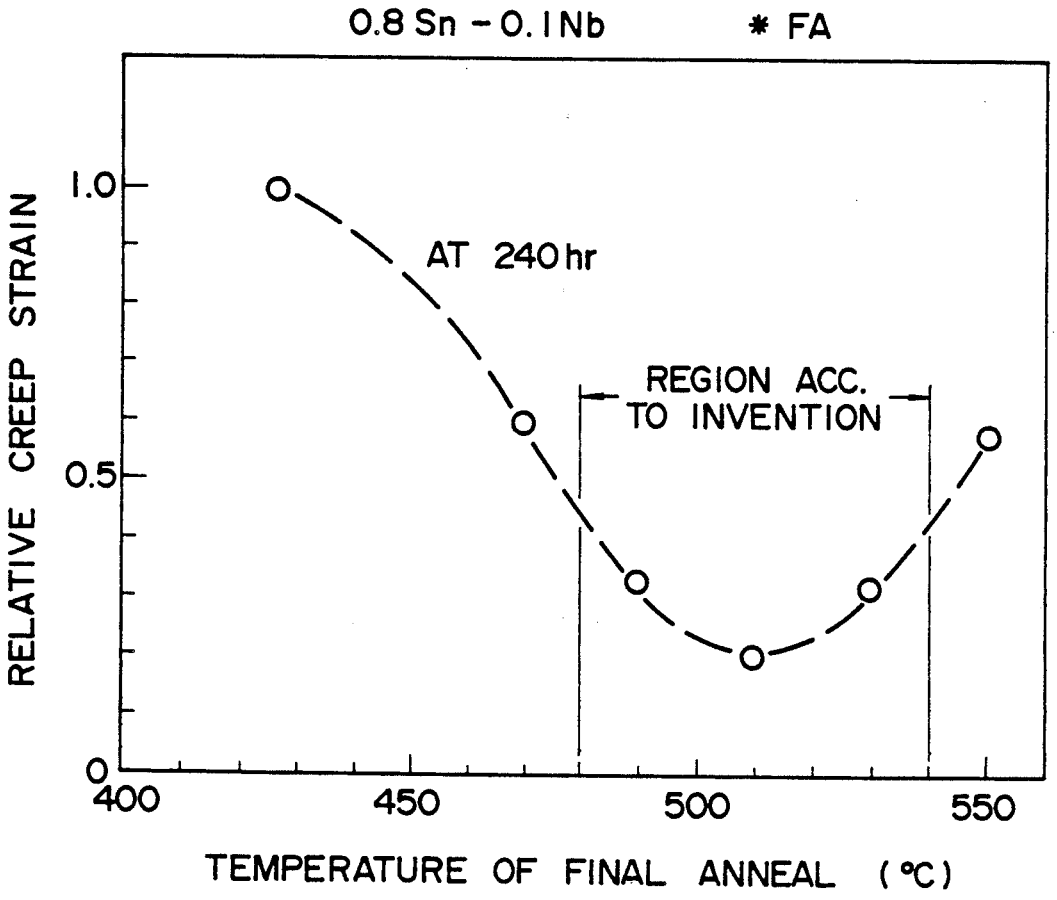
FIG. 6 is a graph showing the relationship between the relative creep strain (ordinate) and the temperature of final annealing (abscissa) for a typical sheath tube made from an alloy according to the invention.

FIG. 6 is a graph showing the relationship between the relative value of creep strain (relative creep strain) of the sheath tube made of the zirconium alloy of the present invention and the temperature of the final annealing thereof. The creep strain was determined in such a manner, that an internal pressure sufficient to produce a stress of 15 $Kg/mm^2$ in the circumferential direction of the tube was impressed inside the tube using argon gas and the tube was maintained at 390° C for 240 hours so as to simulate the force acting on the sheath tube of a fuel element of a actual nuclear reactor, whereupon the change in the outer diameter of the sheath tube was determined. Here, the relative creep strain is a relative value of the observed creep strain for each sample tube relative to that of a sheath tube sample which had been subjected to the final annealing at a temperature of 430° C.

It has been confirmed, as shown in FIG. 6, that the creep strain of sheath tubes made of alloys of the present invention is highly dependent on the temperature of the final annealing in such a manner, that the creep strain decreases with the increase of the temperature of the final annealing from 430° C, reaches a minimum value at 510° C. and then increases again. By effecting the final annealing at a temperature within the range from 480° C to 540° C, the creep strain of the sheath tube can be reduced to a value of ½ or lower of the value for the case where the final annealing is conducted at a temperature of 430° C. If the final annealing is effected for only a quite short period of time, a complete removal of the remaining stress will not be attained. However, a duration of the final annealing over 2 hours is sufficient for the complete removal of the remaining stress. The annealing duration may not be extended superfluously, since the effect of removal of the remaining stress and the effect of annealing on the mechanical strength become quite low after a certain annealing duration, so that a maximum duration of about 4 hours may be sufficient.

As suggested by the above example, a marked improvement in the corrosion resistance is realized with simultaneous attainment of high creep strength by carrying out the final annealing of the sheath tube made of a zirconium alloy having an alloy composition according to the invention at a temperature within the range from 480° C to 540° C for a duration of 2–4 hours.

As explained above, materials of zirconium alloys having alloy compositions as given herein and having been subjected to a final annealing at a temperature of 430°–480° C for about 2–4 hours reveal an improved corrosion resistance without suffering from decrease in the mechanical strength as compared with the conventional Zircaloy employed as construction materials in a nuclear reactor. The zirconium alloys according to the present invention offer higher reliability for the construction materials made of such alloys even when they are employed as construction materials inside a nuclear reactor, allowing thus an extended residence duration within the nuclear reactor, enabling a higher fission rate of the nuclear fuel.

When the final annealing is carried out at a temperature within the range from 480° C to 540° C for a duration of 2–4 hours, a considerable increase in the corrosion resistance is realized with the simultaneous increase of the creep strength.

What is claimed is:

1. A zirconium alloy containing the elements tin, iron, chromium and niobium, comprising, on weight basis, 0.4–1.2% tin, 0.2–0.4% iron, 0.1–0.6% chromium, a maximum of 0.5% niobium and the balance oxygen and zirconium, wherein the sum of weight proportions of tin, iron and chromium is in the range from 0.9 to 1.5%, and the relative yield stress increases with an increase in the sum of the weight percentages of tin, iron, chromium, niobium and oxygen in the alloy while maintaining high corrosion resistance characteristics.

2. A zirconium alloy as claimed in claim 1 wherein the proportions, expressed by weight %, of tin $X_{Sn}$, iron $X_{Fe}$, chromium $X_{Cr}$, niobium $X_{Nb}$ and oxygen $X_o$ satisfy the following equation:

$$X_{Sn}^{0.18}+0.15(X_{Fe}+X_{Cr})+0.13X_{Nb}+4.72X_o \geqq 0.95.$$

3. A zirconium alloy containing the elements tin, iron, and chromium, comprising, on weight basis, 0.4–1.2% tin, 0.2–0.4% iron, 0.1–0.6% chromium, and the balance oxygen and zirconium, wherein the sum of weight proportions of tin, iron and chromium is in the range from 0.9 to 1.5%, and the relative yield stress increases with an increase in the sum of the weight percentages of tin, iron, chromium, and oxygen in the alloy while maintaining high corrosion resistance characteristics.

4. A zirconium alloy as claimed in claim 3 wherein the proportions, expressed by weight % of tin $X_{Sn}$, iron $X_{Fe}$, chromium $X_{Cr}$, and oxygen $X_o$ satisfy the following equation:

$$0.18X_{Sn}+0.15(X_{Fe}+X_{Cr})+4.72X_o \geqq 0.95.$$

* * * * *

UNITED STATES PATENT AND TRADEMARK OFFICE

CERTIFICATE OF CORRECTION

PATENT NO. : 4,992,240

DATED : February 12, 1991

INVENTOR(S) : Kazushi Komatsu, et al.

It is certified that error appears in the above-identified patent and that said Letters Patent is hereby corrected as shown below:

On the title page:

Section [75] "Inventors:", delete "Mitsuru Sugano" and insert therefor -- Mitsuteru Sugano --.

Section [73] "Assignee:", add the following assignee -- Mitsubishi Genshiryoku Kogyo Kabushiki Kaisha, Tokyo, Japan --.

Signed and Sealed this

Twenty-first Day of July, 1992

*Attest:*

DOUGLAS B. COMER

*Attesting Officer*

*Acting Commissioner of Patents and Trademarks*